US005090619A

United States Patent [19]

Barthold et al.

[11] Patent Number: 5,090,619

[45] Date of Patent: Feb. 25, 1992

[54] SNOW GUN HAVING OPTIMIZED MIXING OF COMPRESSED AIR AND WATER FLOWS

[75] Inventors: Scott Barthold, Lyme, N.H.; Bruce A. McLay, Seattle, Wash.

[73] Assignee: Pinnacle Innovations, Lyme, N.H.

[21] Appl. No.: 574,031

[22] Filed: Aug. 29, 1990

[51] Int. Cl.[5] ..... F25C 3/04; B05B 7/04

[52] U.S. Cl. ..... 239/14.2; 239/417; 239/427.3; 239/428; 239/461

[58] Field of Search ..... 239/2.2, 14.2, 428, 239/434.5, 417, 427.3, 461

[56] References Cited

U.S. PATENT DOCUMENTS

| | | | |
|---|---|---|---|
| 218,337 | 8/1879 | Thomas | 239/434.5 X |
| 3,073,534 | 1/1963 | Hampshire | 239/427.5 X |
| 3,310,240 | 3/1967 | Grundman | 239/428 X |
| 3,464,625 | 9/1969 | Carlsson | 239/14.2 X |
| 3,908,903 | 9/1975 | Burns, Jr. | 239/14.2 X |
| 4,353,504 | 10/1982 | Girardin et al. | 239/14.2 |
| 4,634,050 | 1/1987 | Shippee | 239/14.2 |
| 4,742,959 | 5/1988 | Stanchak et al. | 239/14.2 |

FOREIGN PATENT DOCUMENTS

| | | | |
|---|---|---|---|
| 0105493 | 4/1984 | European Pat. Off. | 239/417 |
| 2376384 | 7/1978 | France | 239/14.2 |
| 1150450 | 4/1985 | U.S.S.R. | 239/14.2 |

*Primary Examiner*—Andres Kashnikow
*Assistant Examiner*—William Grant
*Attorney, Agent, or Firm*—Sughrue, Mion, Zinn, Macpeak & Seas

[57] ABSTRACT

A snow gun in the form of a hollow body includes a radially outer cylindrical wall having a longitudinally adjustable central tube coaxially mounted within the hollow body which further includes a radially inner cylindrical wall, radially spaced from the radially outer cylindrical wall and from the central tube. The outer cylindrical wall terminates in a converging, diverging nozzle downstream of facing ends of the radially inner cylindrical wall and the central tube. The end of the radially inner cylindrical wall proximate to the expansion nozzle forms a conical portion which extends beyond the axial end of the central tube to form a second converging and diverging expansion nozzle for a water passage between the central tube of the radially inner cylindrical wall. Compressed air is fed to the interior of the central tube and between the radially outer and radially inner cylindrical walls. Water under pressure is supplied to the annular passage defined by the central tube and the radially inner cylindrical wall. Swirl vanes are provided interiorally of the central tube and intermediate of the radially inner and radially outer cylindrical walls. Compressed air flows impact on a hollow jet of water exiting the second expansion nozzle to induce rotational shear forces in addition to longitudinal shear forces therebetween.

16 Claims, 2 Drawing Sheets

SNOW GUN HAVING OPTIMIZED MIXING OF COMPRESSED AIR AND WATER FLOWS

FIELD OF THE INVENTION

This invention relates to snow making apparatus, and more particularly to an improved snow gun which optimizes the mixing of respective compressed air and water flows and which makes effective use of available water pressure to atomize and/or distribute water particles.

BACKGROUND OF THE INVENTION

The majority of the ski areas in the United States use snow making machines throughout the season to provide complete snow coverage of the slope irrespective of natural snow accumulation. Due to the high cost of energy, there is a continuing need to reduce the cost of making artificial snow, particularly by reduced compressed air consumption. While the initial cost of equipment is high, the expense of operation is considerable.

Snow making apparatus in current use follows two basic forms. Snow making machines of the electric motor-driven fan type have a plurality of nozzles open to the circulation of fan-driven air passing axially through the front end of a cylindrical carrier for the fan and motor. Some compressed air may be fed with the water to the nozzle to facilitate the formation of ice crystals along with the fan induced flow.

The second form is a snow gun utilizing a mixing chamber into which is fed compressed air and water under pressure through separate lines. While low in initial cost, such snow guns are more expensive to operate in terms of the total energy required. The snow gun includes a snow making nozzle which functions to convert water from a hose into droplets and to insure that the droplets are substantially frozen before they hit the ground. The majority of snow gun designs utilize compressed air to both atomize a water stream and impress a high velocity to the water droplets so that they have enough time in the ambient air to freeze. This type of snow making apparatus exhibits several design advantages including light weight and portability, reliable operation and the ability to make snow at all subfreezing wet-bulb temperatures.

Prior known air/water snow guns are generally adjusted by throttling the water pressure to the gun at a hydrant located 50 to 100 feet away. Decreasing the water pressure entering the gun results in greater compressed air flows and generally a drier snow product.

It is applicant's theory that this is the combined result of producing a smaller water droplet in the snow making nozzle, and having less water to freeze in the snow making plume (at the exit of the nozzle). Producing a smaller droplet increases the surface area/volume ratio of the water, enhancing heat transfer rates, while decreasing the water volume decreases the overall heat that must be released from the plume to allow freezing. One of the biggest advantages of the air/water snow making gun is the ability to continually adjust the water droplet characteristics by adjusting the water pressure to the gun. This is especially important in ambient temperatures close to freezing since all other types of snow guns have difficulty in reliably generating small particles.

In the air/water snow gun type of snow making apparatus, the compressed air is very expensive and often consumes over twenty-five times as much energy as that required to provide the water to the snow gun. Since the snow produced is only frozen water, the compressed air is essentially wasted during the conversion process of water to ice particles. Further, there appears to be a limitation on present air/water snow guns or snow nozzles based on their reliance on compressed air flow to adjust the characteristics of the water droplets the result of which is to insufficiently mix compressed air/water flow, produce non-uniform droplets, and fail to make effective use of available water pressure to either atomize or distribute the water particles or both.

It is therefore an object of the present invention to provide a compressed air/water snow gun which minimizes the amount of compressed air required for unit volume of water converted to ice, which optimizes the mixing of compressed air/water flow, which produces uniform droplets under all snow making conditions, which makes effective use of available water pressure to atomize and/or distribute water particles, which adjusts water flow at the nozzle location instead of at a remote hydrant and which permits the use of the full pressure energy of the water stream in the atomization process.

It is a further object of the present invention to provide such an improved compressed air/water snow gun which forms a hollow jet of water injected at high velocity into compressed air streams aligned with the gun direction and passing on both sides of the hollow jet of water to effectively mix the air and water by maximizing the amount of shear forces between the compressed air and water to break up the water jet into droplets of uniform size, to adjust water droplet size independent of compressed air volume, and to employ the high velocity of the water stream passing through a narrow annulus to distribute the water droplets rather than primarily relying on compressed air as in the past.

SUMMARY OF THE INVENTION

The snow gun of the present invention includes an adjustable nozzle configuration to adjust the water flow by providing an annulus of varying width formed by a central tube intersecting a tapered seat. Such structure forms the hollow jet of water with variable thickness depending on the width of the annulus, allowing water droplet size to be adjusted independent of compressed air volume with the produced droplet sizes relatively uniform. The adjustable nozzle configuration facilitates adjustment of water flow at the nozzle location instead of at a remote hydrant and utilizes the full pressure energy of the water stream in the atomization process. Water is injected as a high velocity hollow conical jet at an angle to the gun axis towards that axis. The conical jet of water converges to a focal point downstream of the injection annulus which focal point may be at the throat of the convergent/divergent nozzle, upstream thereof, or downstream thereof. The resulting collision of the high velocity cone-shaped water spray acts to break up the water stream into a fine mist. The mist is enhanced by the impacting air flows along opposite faces of the conical jet of water, particularly downstream of the focal point of that conical water flow. Atomization of the water into fine droplets appears to be the result of the combined action of the shear forces from the internal/external compressed air streams and the collision of the conical pattern of water spray at the focal point. Further, the water is injected at high velocity into the compressed air stream as a hollow jet of water aligned with the gun orifice axis wherein the high velocity of the water stream effectively distributes the water droplets rather than relying on the compressed air to primarily achieve that function. The adjustable nozzle configuration maximizes the surface of area of water exposed to the compressed air flows by the creation of a hollow water jet of water surrounded on both the inside and outside by compressed air, maximizing the amount of shear forces between the compressed air and water which serves to break up the water jet into droplets. The level of shear is increased in the nozzle by causing swirling compressed air flows to contact the hollow jet of water on both sides and in which the rotational shear forces are in opposite directions, one clockwise and the other counterclockwise on respective sides of the hollow jet of water.

Preferably a convergent-divergent nozzle downstream of the adjustable nozzle configuration is provided with a relatively long divergent section to generate high supersonic flows downstream of the nozzle throat thereby increasing the time of the water/ice particle acceleration before leaving from the nozzle exit. To maximize the surface area of the plume that is produced at the exit, the convergent-divergent nozzle defines a divergent path which may change from circular at the throat to a flat ellipse at the nozzle exit. With the oval exit orifice oriented parallel to the ground, all ice particles are projected to about the same height, and the ventilation of the plume to eliminate humidity formed by evaporating droplets is enhanced.

Alternatively, a circular divergent nozzle may be employed.

The invention will now be described in greater detail with reference to a particular embodiment, given by way of example, and set forth in the accompanying drawings.

DESCRIPTION OF THE PREFERRED EMBODIMENT

Figure 1:
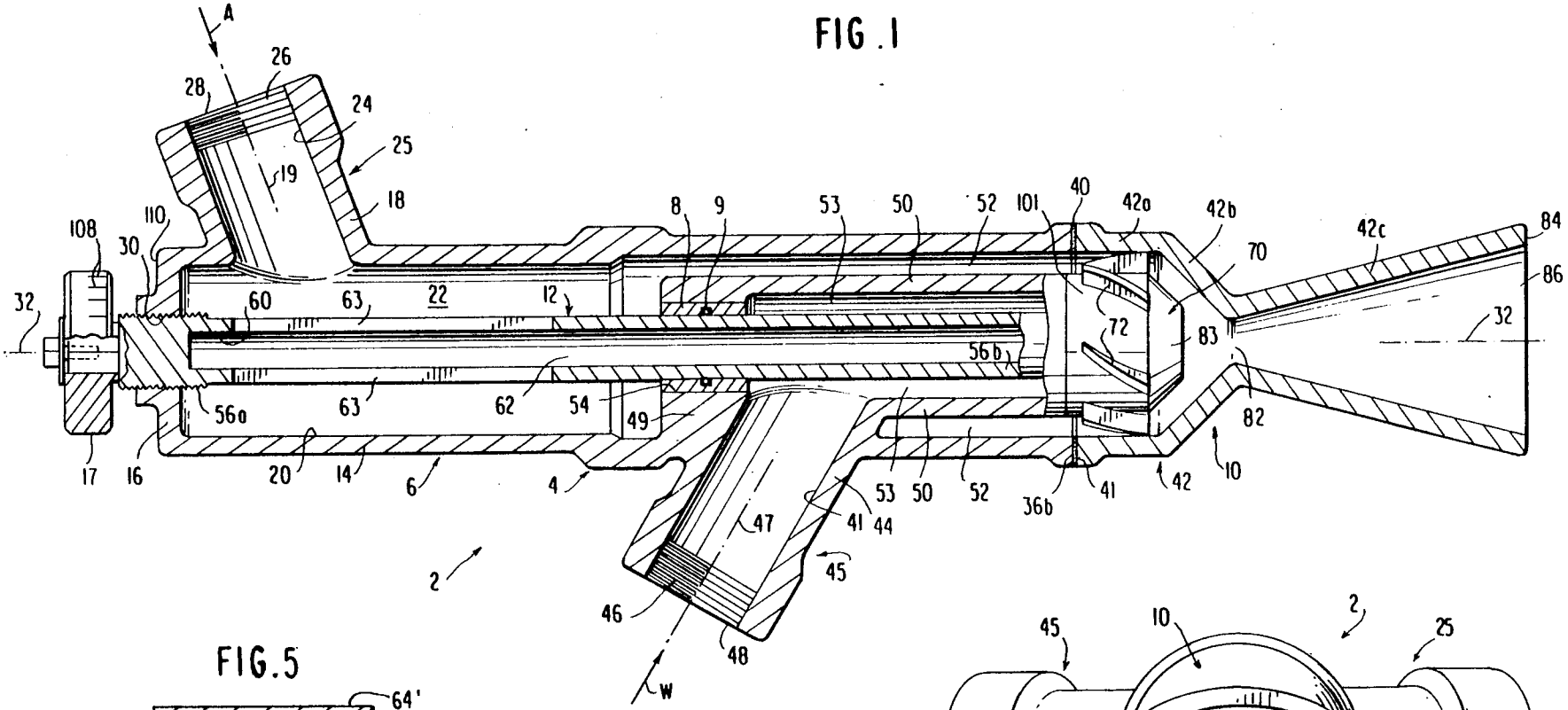
FIG. 1 is a longitudinal, horizontal sectional view of a snow gun forming a preferred embodiment of the present invention.

Referring to the drawings, an improved dual air flow nozzle type air/water snow gun is indicated generally at 2, and comprises a snow gun body 4 formed by two welded or otherwise joined axially abutting sections; a housing 6 and a snow making nozzle section 10. Mounted within body 4, and axially adjustable longitudinally of the body 4 is a central or inner tube 12 which is threadedly coupled to a rear, vertical wall 16 of the housing 6 and slidably positioned within bore 54 of transverse wall 49 of the housing 6 via cylindrical bushing 8 which carries an O-ring seal 9 pressed against the outer periphery of tube 12. The components 6, 10 and 12 may be formed of cast or machined metal such as aluminum. All components are preferably made of metal.

Body 4 therefore takes the form of a hollow cylindrical body, including an outer cylindrical wall 14 having a bore or internal surface 20, which with end wall 16 forms a chamber 22 of annular form about tube 12. Cylindrical wall 14 is concentric about tube 12. A tapped hole 30 within end wall 16 of the body housing 6 receives threaded section **56*a* of tube 12, that section 56*a* being of solid metal, to the rear of bore 60 of the central tube 12 which defines an internal compressed air channel 62. Integrally formed with the rear housing 6 is an oblique air inlet tube 25 which projects horizontally away from the longitudinal axis 32 of body 4, and diagonally to the common axis 32 for tube 12 and body 4. The air inlet tube 25, formed by cylindrical wall 18 has its axis 19 at an angle of about 60° to the axis 32 of body 4. The air inlet tube 25 includes a bore 24 having a tapped or threaded section 26 at an inlet orifice 28 capable of threadably receiving an air inlet hose or the like (not shown) through which is supplied to the snow making gun 2**, compressed air at relatively high pressure from a source indicated schematically by arrow A.

The housing 6 terminates at its forward end and in addition to outer cylindrical outer wall 14, includes integrally, an inner cylindrical wall 50 which is radially spaced from the outer cylindrical wall 14 defining an annular external compressed air channel 52 therebetween. Both outer cylindrical wall 14 and inner cylindrical wall 50 are concentric to tube 12 defining the internal compressed air channel 62. Air gun body housing 6 is cast, machined or otherwise formed to include a rear, transverse wall 49 which includes an axial bore 54 sized slightly larger than the outer diameter of central tube 12 and slidably receives the central tube. A water passage 53 of annular form is defined by the outer periphery of central tube 12 and the inner periphery of the cylindrical inner wall 50 of the snow gun body housing 6.

Housing 6 is provided with a water inlet tube or pipe indicated generally at 45 and is preferably cast integrally with the cylindrical walls 14. 50 of that member. The water inlet tube 45 has its axis 47 horizontal, coplanar with axis 19 of the air inlet tube 25, but projecting to the opposite side of the body 4 from that of the air inlet tube. Additionally, axis 47 is inclined 60° from the common axis 32 of tube 12 and the gun body 4. Water under pressure from a water source, indicated by arrow W, enters the inlet orifice 48 of the water inlet tube 45 to pass from bore 41 of the water inlet tube 45 into annular water passage 53.

The transverse wall 49, except in the area of the water inlet tube 44 terminates short of the interior surface of outer cylindrical wall 14 and integrates with inner cylindrical wall 50 so that there is formed an essentially continuous annular chamber or external compressed air channel 52 between cylindrical walls 14 and 50, through which the compressed air passes directly from air inlet tube 25.

A plurality of elongated slots 63 are formed within the internal compressed air channel tube 12 to the rear of transverse wall 42 of the front housing 8 of the snow gun body 4, within the housing 6, so that a percentage of the incoming compressed air passes axially through the internal compressed air channel 62 for discharge at the forward or front end **56*b* of the central tube 12. At the radially outboard end of the water inlet tube 44 bore 41 is threaded as at 46 so as to threadably receive an inserted male end of a water inlet hose (not shown) connected to the source of water W so that water at essentially the same pressure as that at the water pipe-line servicing the ski slope is provided to annular water passage 53 of the snow gun 2**.

One aspect of the present invention resides in the content of the nozzle section 10 of the snow gun. The key features of the nozzle section is the utilization of a hollow tube of water with compressed air on either side entering the throat of the nozzle section. The longitudinal shift of the air channel, central tube 12 functioning to adjust the rate of flow of water through the annular gap between the forward end of the air channel, central tube 12 and the inner cylindrical wall 50, and the angular orientation of the facing surfaces of the inner cylindrical wall 50 and the compressed air channel tube 12 act to form a hollow cone C of water with collision of the same occurring at the focal point F of the cone, FIG. 3. Tubular wall 42 thereof, forms a converging, diverging venturi nozzle for the gun. In that regard, a rear cylindrical portion 42*a* of nozzle section 10 terminates in a radial end face 41 which abuts a radial end face 36*b* of the outer cylindrical wall 14 of the body housing 6. Once assembly of the gun is completed, the abutting ends of body sections 6 and 10 are glued to each other at 40. Alternatively the nozzle section 10 may be threadedly attached to housing 6 or welded. A conical integral converging wall section 42*b* leads to throat 82 of minimum diameter D for the nozzle section 10. From the throat 82, there extends integrally, a diverging section 42*c* terminating in a nozzle outlet orifice 86 at forward end 84 of the nozzle section 10.

Figure 3:
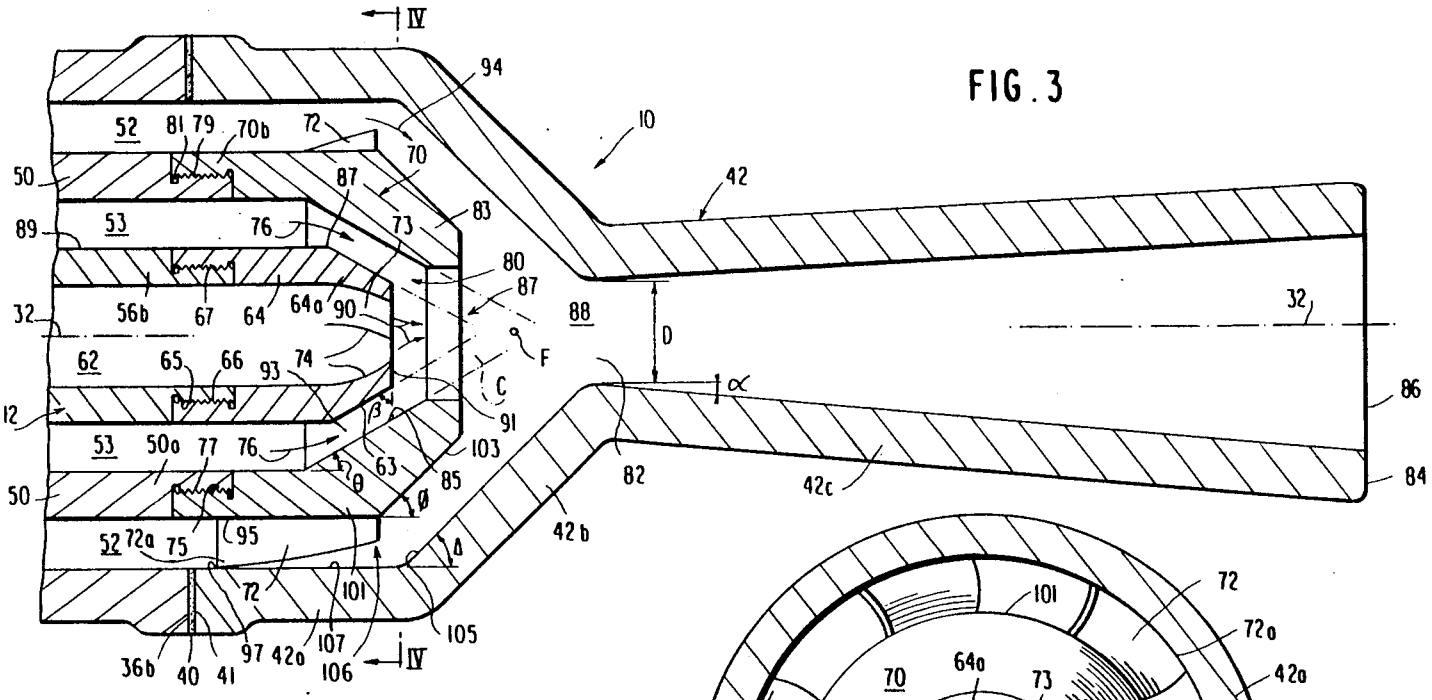
FIG. 3 is an enlarged vertical sectional view of a front portion of the snow gun of FIG. 1.
Figure 4:
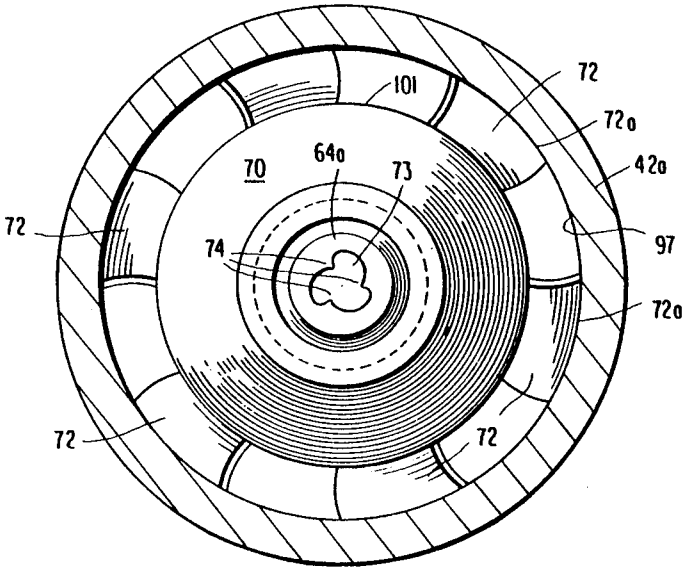
FIG. 4 is a transverse sectional view of the portion of the snow gun about line IV—IV of FIG. 3.

Positioned within the nozzle section 10 of the snow gun body 4 are the front terminal ends 56*b*, 50*a* of central tube 12 and inner cylindrical wall 50 respectively which facilitate optimal compressed air and water mixing and the creation of a hollow annular jet of water as shown by arrows 76 exiting from water passage 53, FIG. 3. In that respect, the central tube 12 terminates at its front end 56*b* in an annular external recess 65 which is threaded on its outer periphery at 66, and which receives threaded internally recessed end 67 of a tubular, inner brass tip 64. Brass tip 64 is of general cylindrical form, having inner and outer diameters corresponding to that of central tube 12, except in the vicinity of swirl vanes 74. Projecting radially inwardly at the forward end 64*a* of the brass tip 64 are shown a plurality of circumferentially spaced, helically twisted swirl vanes 74 which define an inner air primary compressed air discharge nozzle 73, although the vanes 74 may be dispensed with.

Figure 5:
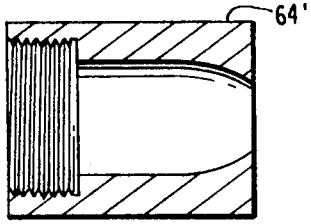
FIG. 5 is a sectional view showing a modified form of the inner brass tip for use with the snow gun of FIG. 3.

Somewhat similarly formed, is a second, larger diameter tubular outer brass tip 70, which at its rear end 70*b*, is provided with an annular recess 75 within the inner periphery thereof which recess is threaded at 77 and which threadably engages threads 79 within an annular recess 81 at the front end of body inner cylindrical wall 50. Recess 81 threadably engages the rear end of brass tip 70. Brass tip 70, unlike brass tip 64, is not generally cylindrical, but, preferably, terminates in a front, conical wall portion 83 at an angle Θ which may range from 30° to 90° to the perpendicular to axis 32, which conical wall portion as shown, converges inwardly. A conical surface 85 at an angle Θ to the axis 32 of the gun which is preferably in the range of about 30° to 60°, thereof forms a seat for the front end of brass tip 64 of the axially adjustable central tube 12. The circular edge 87 defined by the outer peripheral surface 89 and oblique conical surface 63; of inner brass tip 64 forms with conical surface 85 of the outer brass tip 70, a throat 93 of a converging/diverging venturi nozzle, indicated generally at 80 for water under pressure flowing through water passage 53. Conical surface 63 may be eliminated by extending the cylindrical outer periphery of the brass tip 64 beyond edge 87 to radial front surface 91 thereby forming a modified inner brass tip 64 (FIG. 5) forming a different venturi with inner oblique surface 85 of outer brass tip 70.

Further, projecting outwardly from the outer periphery 95 of cylindrical section 101 of the outer brass tip 70 are a plurality of circumferentially spaced counter swirl vanes 72 which may be integrally machined or cast into the outer brass tip 70. The outer swirl vanes 72 terminate in radial tip ends 72*a* which contact the inner periphery 97 of the cylindrical section 42*a* of the nozzle section of the gun body 4. It should be appreciated that the outer periphery 95 of the cylindrical section 101 of brass tip 70, extends preferably parallel with, and over the longitudinal extent of the inner peripheral surface 107 of cylindrical section 42*a* of nozzle section 10. Further, the outer conical surface 103 of conical portion 83 of outer brass tip 70, at an angle Θ of about 45° to the axis 32, extends preferably parallel to the inner conical surface 105 of conical section 42*b* of the nozzle section 10 at a corresponding angle Δ to axis 32. These surfaces define with swirl vanes 72 for the flow of compressed air within external compressed air channel 50, a secondary compressed air expansion nozzle for channel 52. A first air/water mixing chamber is formed at 87 immediately downstream of the front ends of brass tips 64, 70. A further mixing chamber 88 is formed immediately upstream of throat 82 in the illustrated embodiment at the juncture between the converging section 42*b* and diverging section 42*c* of nozzle section 10. As may be appreciated, by shifting the focal point F, FIG. 3, towards and away from throat 82 and even beyond the throat in the direction of the exit orifice 86 there will be considerable effect on the break-up of the water into fine droplets and the creation of snow. The Applicants theorize that the focal point F located about one quarter of an inch downstream from the throat 82 will permit the snow gun to act at maximum efficiency. Such action can be effected by a change in the throat location by changing nozzle sections 10, i.e., the tubular wall 42. Alternatively, by changing the angle β of surface 63 as well as that of angle Θ of conical surface 85 facing the edge of the inner tube 12, the focal point F can be readily shifted towards throat 82. Additionally, the relative velocities of the two air streams may be varied by changing opposed faces 103, 105 from parallel to oblique by converging, in the downstream direction towards throat 82, also altering the creation of water particles by breaking up the conical stream C at upstream and downstream mixing chambers 87. 88 whether those chambers are upstream of the throat 82, at the throat 82, or downstream therefrom. The counter swirl vanes 74 provide an inner, clockwise swirl to the compressed air stream 90 exiting at the exit port 73 for central tube 12, while the outer counter swirl vanes 72 for brass tip 70 produces an outer, counterclockwise swirl for the compressed air flow 94 exiting from between the outer counter swirl vanes 72 of the brass tip 70 at the front end of the external compressed air channel 50. In the embodiment shown, the angle α of divergence of the transversely opposed walls of the diverging section 42*c* of venturi nozzle 82 is 15° with respect to the longitudinal axis 32 of the snow gun 2. The oval configuration provided at the nozzle exit port 86 may be seen in FIG. 2 in comparison to the circular configuration of the throat 82 whose nozzle minimum diameter D defines that circular area.

The swirl vanes 74. 72, when associated with the inner and outer air flows 90, 94, generate swirls in opposite direction; the inner swirl flow clockwise and the outer flow counterclockwise. This induces rotational shear forces in additional to longitudinal shear forces between the hollow jet of water exiting nozzle 80 upon contact with the compressed air flows 90, 100 on both the radial inside and outside surface of the hollow angular jet 76 of water, but cancels out any swirl in the mixed compressed air/water flow outside of the nozzle, i.e.. downstream of the exit orifice 86 of nozzle section 10. To adjust the water flow, a handle 17 is fixed to the rear end of the central tube 12, for manual rotation of central tube 12. The adjustable water nozzle 80 insures an annulus 76 of varying width defined by the edge 87 of brass tip 64 at the front end of the central tube 12 and conical inner face 85 of the conical section 83 of the radially outboard brass tip 70, defining a tapered seat therebetween.

This provides several advantages. The adjustable nozzle 80 forms a hollow jet of water with a variable thickness depending on the spacing of edge 87 of the radially inner brass tip from conical face 85 of the radially outer brass tip 70. A thick hollow jet 76 of water (formed when the annulus 80 is wide), will make larger droplets while a thin jet of water (formed when the annulus is narrow) makes smaller droplets. The invention provides an apparatus for readily adjusting water droplet size, of the water mixing in chamber 87 with the primary compressed air stream 90 and that within downstream mixing chamber 88, mixing with the secondary, radially outer compressed air stream 94 exiting from external compressed air channel 52. Adjustment of water droplet size is thus independent of the compressed air volume.

Additionally, the snow gun of the present invention insures that the droplet sizes produced are relatively uniform. Water flow is adjusted at the nozzle 80 location by axial shifting of central tube 12, thus utilizing the full pressure energy of the water stream 76 in the atomization process which takes place within mixing chambers 87, 88. Additionally, the water is injected at high velocity at the water nozzle 80 adjustable width annulus 76 into the compressed air stream 90 at mixing chamber 87 aligned with the gun direction and into the secondary compressed air stream 94 emanating from the external compressed air chamber 50. The result of this is the utilization of the high velocity of the water stream W passing through the narrow annulus 76 to be used in the distribution of the water droplets rather than relying on compressed air to primarily achieve this function, as occurs in the prior known snow guns. The operator may readily adjust the rate of water flow at the gun 2 location by rotation of handle 17 rather than having to walk fifty to one hundred feet to a hydrant location where the water hose (not shown) is connected to water source W. Preferably the handle which bears a number of gradations on its exterior periphery, is rotated to match one of those gradations with a fixed line on the housing 4 to set the axial distance of the end of the central tube 12 from the inner cylindrical wall 50 and the flow rate of water forming the hollow conical flow with compressed air flow impacting the same on opposite sides thereof.

It is not necessary but desirable under certain conditions, to utilize the swirl vanes 74 and counter swirl vanes 72 to generate swirls in opposite directions, one clockwise and the other counterclockwise on the respective inside and outside of the hollow water jet 76 surrounded by compressed air. By maximizing the amount of shear force developed between the compressed air streams 90, 94 and water jet 76, the water breaks up more readily into droplets. The opposite direction generated swirls of the expanding, compressed air induce rotation shear forces in addition to the longitudinal shear forces normally employed in the creation of water jet droplets by impact between the compressed air and the water flows, but cancel out any swirl in the mixed flow downstream of the nozzle exit 86. This is important, since, as a result, a swirling flow leaving the snow gun expands radially at a rapid rate. Normally this would be a disadvantage in a conventional snow gun since a portion of the radial flow will be pointed towards the ground, reducing the time that the water droplets in that portion are airborne before they hit the ground.

Figure 2:
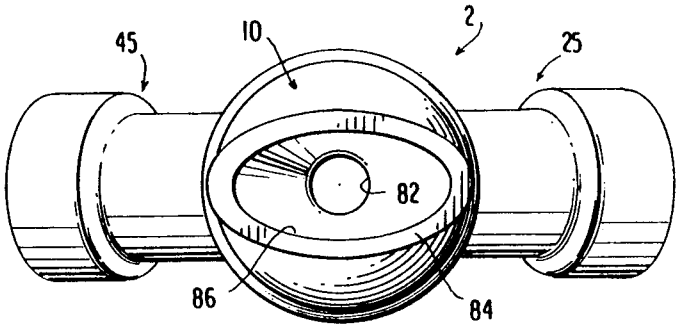
FIG. 2 is a front elevational view of the snow gun of FIG. 1.

However, in the illustrated embodiment, as readily seen by reference to FIGS. 1 and 2, the oval discharge end of the diverging section 42*c* of the nozzle section being horizontal, attenuates the uniform radial flow dispersion of the swirling flow, leaving the snow gun nozzle exit 86. Snow distribution is facilitated since the snow gun maximizes the dispersion capability of the compressed air by using a convergent-divergent nozzle with a relatively long divergence section 42*c*. The result of the generation of highly supersonic air and water (ice) particle flows downstream of the nozzle throat 82 provides enough time for the water/ice particles to be accelerated to a maximum extent prior to leaving the nozzle at the nozzle exit 86. A cone shaped nozzle provides an advantage for distributing length. A flat spray gives wider pattern preferred embodiment up to individual user. To maximize the surface area of the developed plume that is produced, the convergent-divergent nozzle is designed with a divergence that goes from round at the throat, to a flat ellipse nozzle exit 86. Alternatively, the convergent, divergent nozzle section tubular wall 42 may be conical throughout the diverging section 42*c*. Further, the production of a flat "wedge-shaped" plume rather than a conventional cone-shaped plume provides a flat plume which when oriented horizontally, provides a clear advantage as all particles are projected to about the same height. As a result, they are airborne about the same amount of time, and the ventilation of the plume is increased to maximize the elimination of humidity formed by the evaporating droplets.

The air flow, conveniently split into two separate flows within the body housing 6, is maintained through the housing, and each flow is caused to pass through a convergent-divergent cross section on opposite sides of the hollow jet of water 73 exiting from the annulus 80 of the converging-diverging venturi nozzle section 10 created by radially spaced vanes of the inner brass tip 64 and outer brass tip 70. The split compressed air flows converge on each other and on an interposed hollow water stream. As a result, the water is bombarded on both sides by high velocity air streams which may swirl in opposite directions, blasting the water ligaments from the two sides of the annulus hollow water, which is very effective in the production of a fine spray, with an increased number of particles of reduced size, improving the quality of the snow particles produced with minimal energy consumption. In theory, the nozzle section is designed so as to produce oblique shocks at the exit plane of compressed air of the nozzles with such shocks being very effective in breaking up water jets with multiple shocks even more effective than the sum of their individual contributions if they had acted alone. With the two separate air flows in the nozzle, there are produced two sets of oblique shocks, providing a very beneficial multiple shock effect.

It is important to keep in mind that by controlling the injection geometry of the water injection nozzle 80, the water flow rate into the nozzle may be readily increased or decreased with a minimum change in droplet size. By the addition of swirl vanes (or ports) in the inner and outer air passages improved mixing and atomization occurs. The preferred embodiment, as illustrated, does not require that the air gun be shut down in order to adjust the position of the central tube. The adjustments are made during full operation and there is no need to shut down the water or air flow, or change the pressure by adjusting the hydrant valve. Further, while a mechanical adjustment of the axial position of the central tube is illustrated using the threaded coupling to rear end wall 16 of the rear section of the body, it is possible to employ a central tube which is axially positioned by means of an adjustable coil spring instead of threads. The coil spring may be designed to automatically position the central tube in response to variation in inlet water pressure at water inlet tube 44 and to automatically increase the thickness of the hollow jet of water exiting the water nozzle 80 with increased water pressure. Under such conditions, the nozzle could be set for a particular water flow rate, or air/water flow rate independent of adjustment and pressures at the hydrant or other water source W.

While the invention has been described in detail and with reference to a specific embodiment thereof, it will be apparent to one skilled in the art that various changes and modifications may be made thereto without departing from the spirit and scope of the invention.

What is claimed is:

1. A snow gun for atomizing a mixture of air and water to form artificial snow, said gun comprising:

a hollow body including an outer cylindrical wall, a central tube coaxially positioned within said outer cylindrical wall and extending interiorally of said hollow body, a radially inner cylindrical wall concentrically positioned about said central tube, radially spaced from said outer cylindrical wall and said central tube and extending longitudinally within said hollow body, said outer cylindrical wall terminating at one end in a converging and diverging first expansion nozzle including a reduced diameter throat and defining at least one mixing chamber upstream of said throat, said central tube and said radially inner wall terminating short of said throat, said central tube forming an internal compressed air channel, said central tube and said radially inner wall forming an annular water passage, and said radially inner wall and said radially outer wall defining an external compressed air channel, means for sealing said water passage from said internal compressed air channel and said external compressed air channel, means for supplying compressed air to said internal compressed air channel and said external compressed air channel for discharge into said converging and diverging expansion nozzle, and a second expansion nozzle defined by said central tube and said radially inner cylindrical wall at ends thereof proximate to said first converging and diverging expansion nozzle such that a hollow jet of water discharges at high velocity from said second expansion nozzle and is injected at high velocity into compressed air streams aligned with the gun direction and passing on both sides of the hollow jet of water from said internal compressed air channel and said external compressed air channel respectively in said at least one mixing chamber in proximity to said throat to effectively mix the air and water by maximizing the amount of shear forces between the compressed air and water to break up the water jet into droplets of uniform size and to employ the high velocity of the water stream passing through a narrow annulus in said second expansion nozzle to effectively distribute the water droplets within the flows of compressed air streams on opposite sides thereof while facilitating mixing of the air and water within said at least one mixing chamber downstream of the central tube and in proximity to said throat, thereby minimizing the amount of compressed air required for the unit volume of water converted to ice while making effective use of available water pressure to both atomize and distribute water particles.

2. The snow gun as claimed in claim 1 wherein, means are provided on said radially inner cylindrical wall for forming with the end of said central tube proximate to said converging and diverging first expansion nozzle, said second expansion nozzle, and said snow gun further includes;

means for axially adjusting the position of said central tube within said radially inner cylindrical wall to vary the thickness of said hollow jet of water to thereby optimize the mixing of compressed air/water flow and to produce uniform droplets of water under all snow making conditions.

3. The snow gun as claimed in claim 2, further comprising a first set of swirl vanes mounted within said external compressed air channel proximate to the end of said radially inner cylindrical wall, and a second set of swirl vanes mounted within said internal compressed air channel of said central tube at the end proximate to said converging and diverging first expansion nozzle to induce rotational shear forces in addition to longitudinal shear forces between the hollow jet of water exiting from said second expansion nozzle upon contact with the compressed air flows on opposite sides thereof.

4. The snow gun as claimed in claim 3, wherein said swirl vanes are oriented oppositely so as to generate swirls in opposite directions, thereby tending to cancel out any swirl in the compressed air/water flow outside of the first expansion nozzle to minimize adverse effects on the snow plume formed at the exit of the first expansion nozzle.

5. The snow gun as claimed in claim 1, wherein said hollow body includes an end wall transverse to the longitudinal axis of the body at the end of the gun remote from said converging, diverging first expansion nozzle;

a threaded axial bore is provided within said end wall, and wherein said central tube includes a threaded outer peripheral portion threadedly received within the threaded bore of said end wall, said central tube includes means within an end projecting axially externally beyond said end wall for facilitating rotation of said tube within, said body and adjustment of thickness of the narrow annulus formed between the end of said central tube and said radially inner wall proximate to said diverging, converging first expansion nozzle to vary the thickness of the hollow water jet and the size of the particles formed by atomization of the water film of said hollow jet of water formed by said second expansion nozzle, and to vary the ratio of water droplets to compressed air flow of said snow gun irrespective of compressed air volume.

6. The snow gun as claimed in claim 1, wherein the end of said radially inner cylindrical wall proximate to said diverging, converging first expansion nozzle is bent obliquely inwardly towards the end of the central tube proximate thereto, and extends slightly beyond that end to form the second expansion nozzle therebetween for said water passing through said water passage, and wherein mixing of said water occurs with said dual compressed air streams on opposite sides of the hollow jet of water within said at least one mixing chamber.

7. The snow gun as claimed in claim 6, wherein the end of said radially inner cylindrical wall terminates in a conical portion oblique to the longitudinal axis of the hollow body.

8. The snow gun as claimed in claim 7, wherein said conical portion of said radially inner cylindrical wall converges in a downstream direction towards the converging section of said radially outer cylindrical wall so as to partially define a third expansion nozzle for said external compressed air channel flow stream, upstream of said first expansion nozzle throat.

9. The snow gun as claimed in claim 1, wherein the ends of said central tube and said radially inner cylindrical wall are constituted by replaceable brass tips including integral swirl vanes on the internal periphery of the central tube and the outer periphery of the radially inner cylindrical wall, respectively.

10. The snow gun as claimed in claim 1, wherein said converging and diverging first expansion nozzle changes from a round configuration at the throat to an ellipse at the nozzle exit with a long axis of the ellipse horizontal.

11. The snow gun as claimed in claim 1, wherein said hollow body includes integrally, a transverse wall integrated with said radially inner cylindrical wall, an axial bore is formed within said transverse wall, a cylindrical bushing is fixedly mounted within said axial bore said cylindrical bushing slidably mounts and is concentric about said central tube, and said bushing includes a O-ring seal on the inner periphery thereof engaging said central tube and sealing off the water passage defined by the outer periphery of the central tube and the inner periphery of said radially inner cylindrical wall of the hollow body.

12. The snow gun as claimed in claim 5, wherein the end of said central tube projecting axially externally beyond the hollow body end wall for facilitating rotation of said tube carries a control knob bearing circumferentially spaced gradations on the peripheral surface thereof for indicating the angular position of the threaded central tube within the threaded bore of said end wall transverse to the longitudinal axis of the body at the end of the gun remote from said converging diverging first expansion nozzle, and thus the size of the narrow annular gap between the end of said central tube and said radially inner cylindrical wall of said second expansion nozzle.

13. The snow gun as claimed in claim 6, wherein the end of said central tube proximate to said radially inner cylindrical wall has an edge, facing said oblique inner cylindrical wall which is at an angle $\beta$ within the range of 30° to 90° to the axis of the central tube.

14. The snow gun as claimed in claim 13, wherein said angle $\beta$ is approximately 60°.

15. The snow gun as claimed in claim 13, wherein said angle $\beta$ is approximately 90°.

16. The snow gun as claimed in claim 6, wherein surface of said obliquely bent end of the radially inner cylindrical wall proximate to said converging first expansion nozzle facing said end of the central tube proximate thereto is in the range of 30° to 60° to the axis of the central tube and, wherein the outer surface of said obliquely bent end of said radially inner cylindrical wall is at an angle of approximately 45° to the axis of the central tube.

* * * * *